US005929369A

United States Patent [19]

Bissig et al.

[11] Patent Number: 5,929,369

[45] Date of Patent: Jul. 27, 1999

[54] ASSEMBLY FOR THE OPTICAL MARKING OF THE FLIGHT PATH OF A PROJECTILE OR AEROPLANE ACCELERATED BY A POWER UNIT

[75] Inventors: Josef Bissig, Altdorf; Rolf Oechslin, Spiez; Walter Rauber, Gwatt, all of Switzerland

[73] Assignee: Schweizerische Eidgenossenschaft Vertreten Durch die SM Schweizerische Munitionsunternehmung der Gruppe Rustung, Thun, Switzerland

[21] Appl. No.: 09/028,702

[22] Filed: Feb. 24, 1998

Related U.S. Application Data

[60] Provisional application No. 60/038,309, Feb. 25, 1997.

[51] Int. Cl.[6] ..... F42B 12/48

[52] U.S. Cl. ..... 102/334; 102/513; 102/529; 60/616

[58] Field of Search ..... 102/334, 498, 102/513, 529; 60/616

[56] References Cited

U.S. PATENT DOCUMENTS

| | | | |
|---|---|---|---|
| 3,625,155 | 12/1971 | Douda et al. | 102/334 |
| 3,712,228 | 1/1973 | Handler et al. | 102/513 |
| 3,726,226 | 4/1973 | Grandy | 102/334 |
| 4,227,460 | 10/1980 | Krone et al. | 102/513 |
| 4,436,034 | 3/1984 | Jacobsen et al. | 102/334 |
| 4,438,700 | 3/1984 | Knapp | 102/334 |
| 4,446,794 | 5/1984 | Simmons | 102/334 |
| 4,726,295 | 2/1988 | Embury, Jr. et al. | 102/334 |
| 4,732,086 | 3/1988 | Schiestl et al. | 102/513 |
| 5,661,257 | 8/1997 | Nielson et al. | 102/334 |

FOREIGN PATENT DOCUMENTS

| | | | |
|---|---|---|---|
| 583176 | 2/1994 | European Pat. Off. | 102/334 |
| 4101392 | 7/1992 | Germany | 102/334 |

*Primary Examiner*—Peter A. Nelson
*Attorney, Agent, or Firm*—Schweitzer Cornman Gross & Bondell LLP

[57] ABSTRACT

An assembly for generating an optical marking of the flight path of an air/space vehicle propelled by a power unit is associated with the power unit, and mixes the marking output of the generator with either the exhaust of the power unit or air streaming past the vehicle. The generator may generate smoke or steam. In the case of a smoke generator, the assembly may include an annular chamber surrounding a central passageway through which the power unit exhaust passes. The exhaust ignites a smoke-generating charge in the annular chamber, the smoke generated passing through bores in the annular chamber.

13 Claims, 4 Drawing Sheets

ASSEMBLY FOR THE OPTICAL MARKING OF THE FLIGHT PATH OF A PROJECTILE OR AEROPLANE ACCELERATED BY A POWER UNIT

This application claims the priority of provisional application Serial No. 60/038,309, filed Feb. 25, 1997.

The present invention relates to an assembly for generating an optical marking of the flight path of a rocket, an airplane or the like, and particularly a missile, accelerated and propelled by a power unit, which assembly is associated with the power unit and admixes smoke and/or steam particles to the emerging gas stream and/or to the flowing air.

BACKGROUND OF THE INVENTION

It is known to measure and to record the flight path of missiles or airplanes with optical tracking devices. In connection with the training of personnel for the operation and deployment of ground to air, ground to ground and air to ground rockets it is particularly helpful to provide an optically-visible trace of the flight path of the missile, at least in its initial stage.

Aircraft pilots can be better trained for evasive actions when they are able to early and safely observe and recognize the initial path of training rockets.

BRIEF DESCRIPTION OF THE INVENTION

It is therefore an aim of the present invention to create an assembly which can be associated with a power unit or engine of a missile, rocket, airplane or other vehicle without impairing the motive power of the engine and without influencing the steering behavior of the vehicle.

Moreover, system security for the vehicle should not be jeopardized by the assembly, even under extreme operating conditions.

The above and other objects and aims are met by the present invention, wherein a smoke and/or steam generating unit is attached to the engine or motor of the vehicle, and is activated or ignited by the exhaust of the engine.

A heat sensitive foil may be provided to be melted and/or ignited by the hot exhaust gases, allowing activation of the generator.

A diffuser area may be incorporated to provide favorable streaming behavior and generation of a coaxial smoke distribution. By inclusion of bore holes in the diffuser area excess pressure in the smoke generator can be reduced and malfunctions, especially at higher temperatures, can be avoided. Locking spigots may be used in the bore holes to initially seal the generating unit and subsequently reduce the creation of excess pressures subsequently being expelled from the bore holes. A holding band can facilitate the assembly of the spigots and can provide a favorable streaming behavior for the exiting smoke.

A further favorable streaming behavior can be obtained by utilization of a bomb shaped configuration to the assembly. Such a configuration can lead the hot exhaust gases of the power unit in the direction of the heat sensitive foil and accelerates its ignition.

An appropriate pyrotechnic mixture, ignited by the exhaust, generates smoke for the optical marking. Alternatively, the present invention may utilize a steam generation unit, whereby water pressure in the associated water pipes can be easily created by the build-up pressure of the rocket and the initialization of the steam forming occurs by ablation and/or burning down of locking tappets or safety devices.

BRIEF DESCRIPTION OF THE DRAWINGS

The subject of the present invention will be further explained in detail in the following disclosure of practical implementing examples, particularly when considered in connection with the annexed drawings, wherein.

In all figures the same functional parts are designated with the same reference numbers.

DETAILED DESCRIPTION OF THE INVENTION

Figure 1:
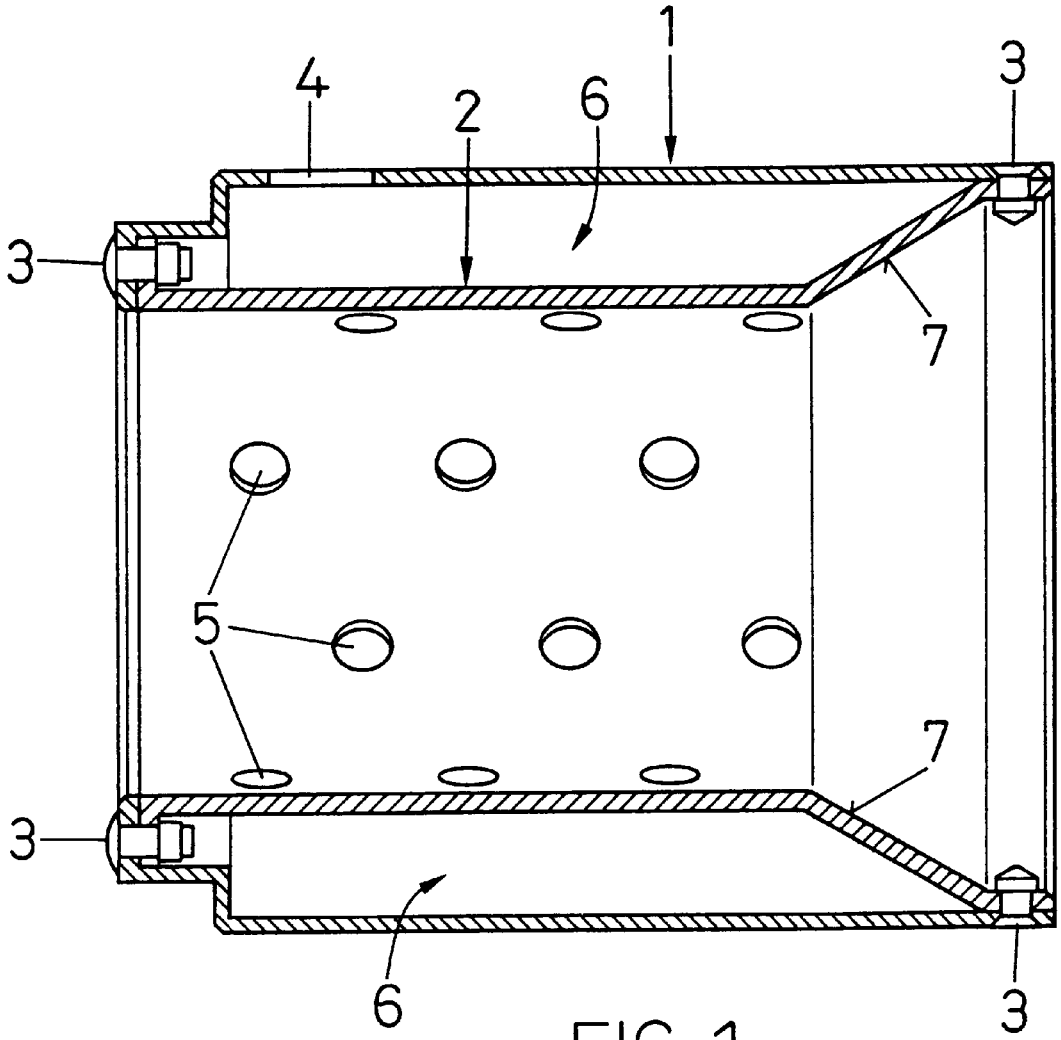
FIG. 1 depicts an operative smoke generating unit of the present invention in sectional view, without its smoke-generating filling and inner covering therefor.

With initial reference to FIG. 1, a smoke-generating unit in accordance with the invention includes an outer ring 1 of a hollow cylinder, which, in association with an inner cylinder in the form of a sieved tube 2 having a plurality of cylindrical bore holes 5, forms a hollow, annular space or chamber surrounding a generally cylindrical central bore. The sieved tube 2 tapers outwardly at 7 to the outer ring 1. The outer ring 1 and the sieved tube 2 are solidly interconnected in a known manner by rivets 3.

An opening 4 is provided in the outer ring 1, which allows the filling (charging) of a smoke-generating assembly or mixture into the hollow space formed between tubes 1 and 2, which hollow space serves as a burning chamber 6. The burning chamber 6, wherein smoke formation takes place, contains at its rear end a cone-shaped diffuser area formed by the tapered portion 7 of the sieved tube.

Figure 2:
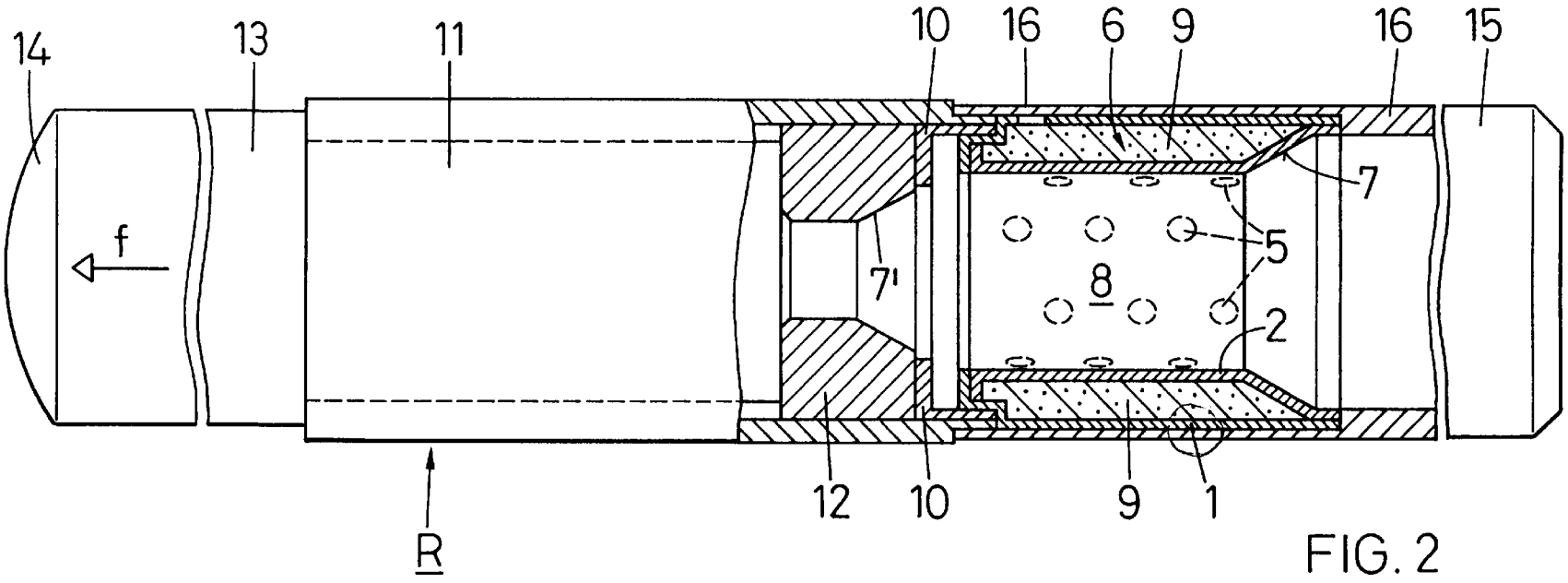
FIG. 2 depicts the smoke generating unit of FIG. 1 built into a rocket for training purposes.

As shown in FIG. 2, the smoke-generating unit of FIG. 1 is inserted into the housing 16 of a training rocket R. The outer ring 1 is mechanically connected to a known propelling nozzle 12 of a boost motor 11 by an adapter flange 10 which engages a peripheral shoulder formed in the outer ring. The rocket engine or boost motor 11 may be, for example, a solid fuel booster.

The training rocket may include, in the forward or launch direction f, an elongated front body 13 (eject bar) having a painted end 14 which, as known in the art, is chosen to have the mass and moments of inertia properties of a real guided missile to allow effective simulation thereof in flight. The rear end part 15 of the training rocket is formed analogously to that of a guided missile as known in the art. A known smoke-generating assembly 9 is positioned in the burning chamber 6 formed by the outer ring 1 and the sieved tube 2. The bore holes 5 in the sieved tube 2 are covered by an easily inflammable foil 8. The diffuser area 7 is chosen to have a greater aperture angle than the conical part of the nozzle bore hole 7' in propelling nozzle 12.

The operational mode of the present invention is of greatest simplicity and accordingly of the highest operational safety. When the rocket engine 11 is ignited hot gases are formed, which encounter the foil 8 upon exiting the nozzle bore hole 7', and ignite the foil. The smoke assembly or mixture 9 in the burning chamber 6 is thus ignited; the smoke generated by the smoke assembly exits the burning chamber through the bore holes 5 and is carried by the engine exhaust and are present for the entirety of the flight of the rocket, and form a corresponding visible tail which shows the flight path of the rocket.

In the previously described and tested implementing example a ground-to-air rocket of the "STINGER" type (see folder 01-7 10A (undated) of Brunswick Corporation, Defense Division, 3333 Harbor Blvd, Costa Mesa, Calif. 92526 USA: STINGER Weapon System Training STLS, and STINGER Launch Simulator STLS, respectively) has been utilized. This missile has a boost motor accelerating the missile to a necessary minimal speed for launch of 30 m/s. After leaving its launcher tube the thrust period of the boost motor is terminated. Accordingly, exhaust gases are no longer generated by the booster. However, the smoke assembly 9 is still active and the generated smoke drawn by the air flowing past the missile, continues to exit the booster to leave a visible trail. The training missile R has no cruise engine.

The smoke assembly 9 may comprise a pyrotechnic mixture of 22% zinc oxide, 18% polyvinylchloride, a reacting mixture of 22% zinc diamino chloride and 36% ammonium perchlorate and 2% collodion cotton E220. The pulverized smoke-generating mixture is compressed in a known manner, such as by means of a vibrator, while it is poured into the burning chamber 6. With such a mixture the incorporation of twenty-four bore holes of 5.8 mm in diameter each, distributed over the whole surface of the cylinder of the sieved tube 2, have proven satisfactory.

Both the outer ring 1 and the sieved tube 2 may be fabricated from a commercially available chromium/nickel steel. The rivets 3 may be made of an aluminum alloy while a cover for the filling opening 4 may be formed from a commercially available aluminum foil with an adhesive surface, such as 3M Company "Scotch" brand tape, #1170, according to MIL-A-46050. The heat-sensitive foil 8 may likewise be a commercially available aluminum holding band (CO-ROPLAST #919, aluminized; or Permapack Ltd. CH-9401 Rohr-schach).

Figure 3:
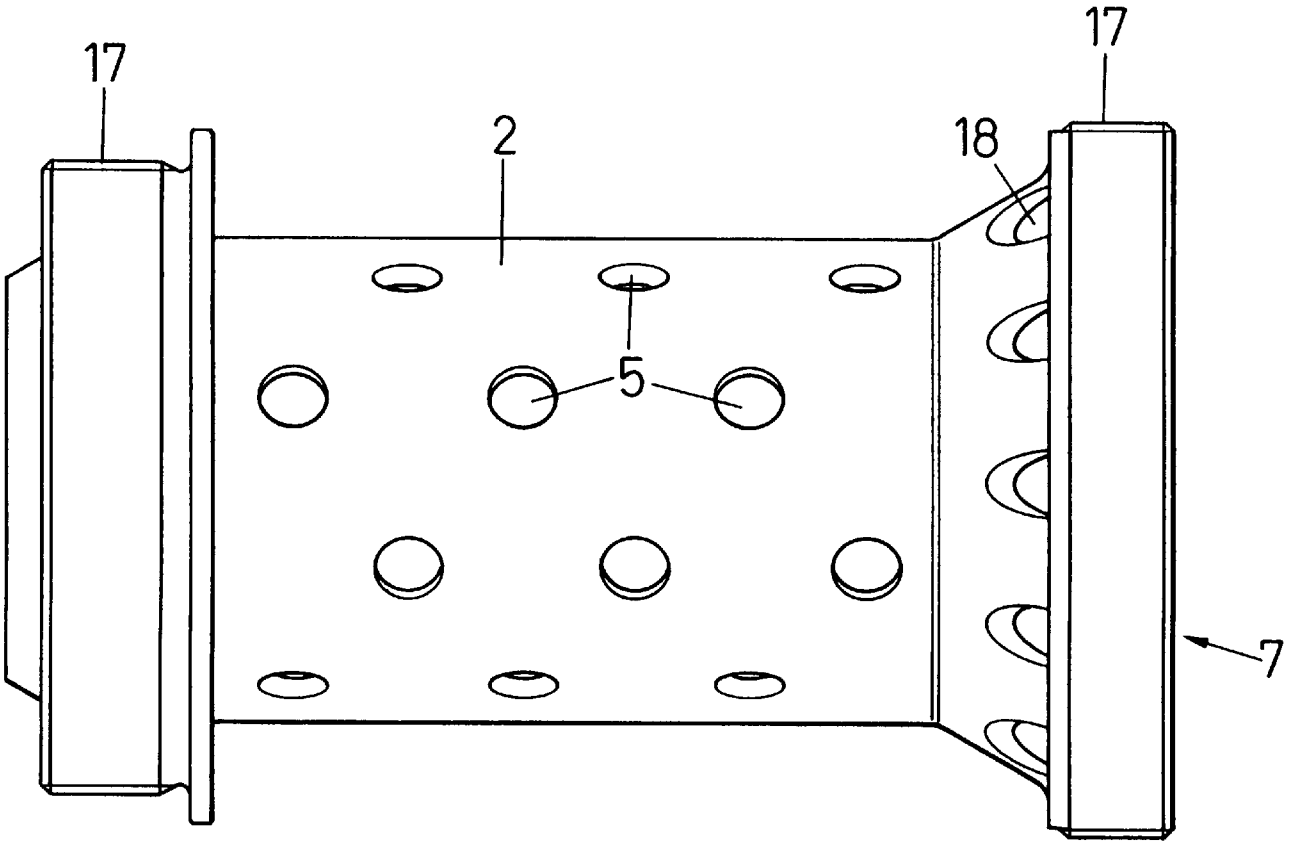
FIG. 3 is a detail view of a sieved tube of an alternative embodiment of a smoke unit, wherein axial bore holes are provided in the diffuser area.

In practical testing of the previously-described embodiment it appeared that at surrounding temperatures above 50° C. the exhaust of the rocket engine 11 may expand the outer ring 1 and as a result thereof the rocket R can obstruct or, in extreme cases can jam in, the launcher tube. Accordingly, in a further preferred implementing example the invention may thus include the shaped sieved tube 2 as shown in FIG. 3. As shown therein, this sieved tube 2 contains bore holes 5, identical to those according to FIG. 1, in its cylindrical portion. Additionally, however, the sieved tube 2 contains on each of its ends a lateral outside threaded portion 17. Its diffuser area 7 includes axially arranged bore holes 18. The axial bore holes 18 are initially sealed by means of a ring-shaped holding band 19 having locking spigots 20, as shown in FIG. 4.

Figure 5:
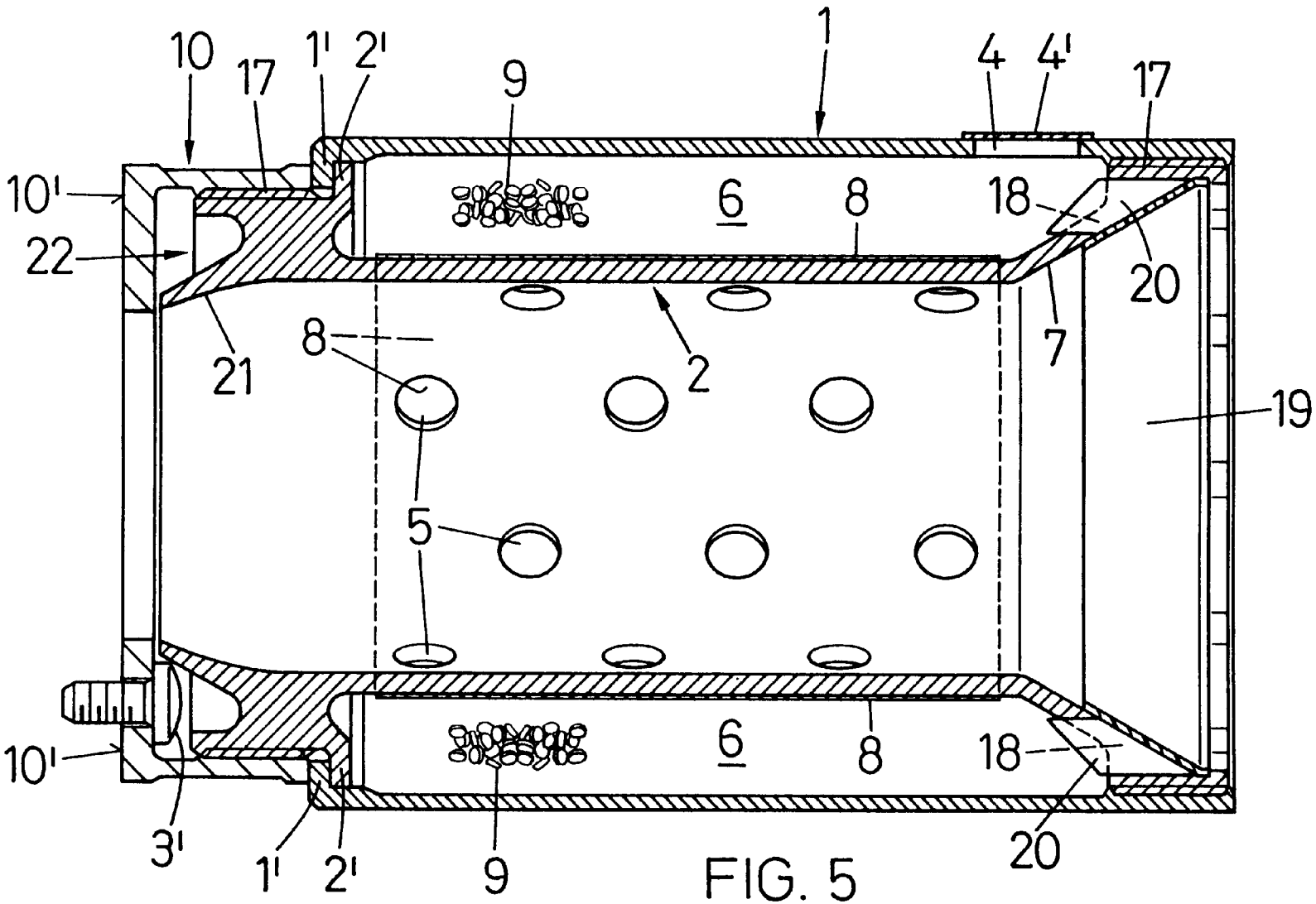
FIG. 5 is a sectional view of an assembled smoke unit with the components of FIGS. 3 and 4.

FIG. 5 depicts this embodiment as a whole in section. After lining of the cylindrical casing of the sieved tube 2 with the heat sensitive foil 8, the adapter flange 10 is mounted to the propelling nozzle 12 of the rocket engine 11 by four fastening screws 3' extending through its forward portion 10' (see FIG. 2). The heads of the fastening screws 3' are located in ring-shaped recess 22. The outer ring 1 is slid over the sieved tube 2 from the left side and screwed to its outside threaded portions 17 of the sieved tube. The flanged portion 1' of the outer ring tightly bears against the flanged portion 2' of the sieved tube 2.

Figure 4:
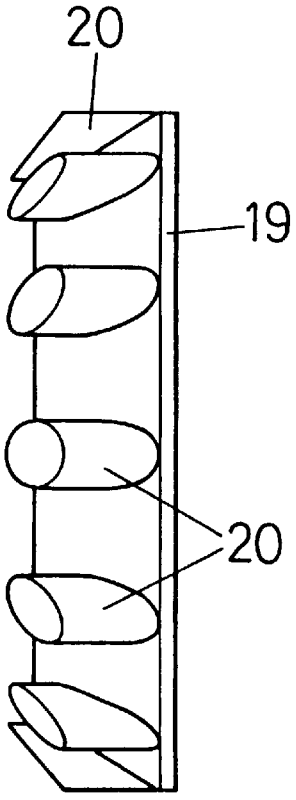
FIG. 4 depicts a holding band with locking spigots for the locking of the bore holes in the diffuser area of the sieved tube of FIG. 3.

In contrast the embodiment of FIGS. 1 and 2, and the sieved tube 2 of the embodiment of FIGS. 3–5 has a more favorable streaming behavior, as it includes an outwardly tapered inlet opening 21, which assists in leading the driving exhaust gases of the rocket engine through the bore holes 5 towards the foil 8 and in accelerating its ignition.

The locking spigots 20 and their mounting band 19 may be inserted from the exterior into the diffuser area bore holes 18. The holding band 19 is then affixed to the tapered portion of the sieved tube 2, such as by means of a commercially available silicone adhesive. The smoke assembly/mixture, typically in the form of small pellets, is loaded and compressed into the burning chamber 6. The filling opening 4 is then closed.

The ring-shaped band 19 and locking spigots 20 may be formed with precision as a one-part assembly in a die-casting ("spraying") process, and may be formed from polyurethane. In contrast to the first embodiment, the outer ring 1 and the sieved tube 2 may be made of super high strength aluminum-alloy (such as "Perunal 215" of Alusuisse Ltd., Switzerland (DIN 3.4365; U.S. denomination 7075-T6). Use of this aluminum alloy can result in weight saving compared with that of the previously-described embodiment and can be produced more economically.

In a further modification from the embodiment of FIGS. 1 and 2, the form fitting construction for the smoke unit shown there is abandoned, whereby the smoke unit can be selectively mounted in the training rocket R by use of the screwed adapter flange 10.

By use of the present invention the launch of a rocket may be tracked, making it easier for ground personnel to learn and practice the necessary manipulations for orientation and launching. In the same way pilots can more easily be trained in evasive actions when they are able to observe the flight path of a rocket from their perspective. In case of emergency, i.e. when a rocket is launched with live ammunition in a non-combative environment, the visual trail generated by the rocket engine or booster utilizing the present invention will be sufficient for the pilot to recognize not only the launch but also to start evasive actions; the flight dynamics of a conventional ground-to-air-rocket is typically very limited due to system engineering constraints.

One skilled in the art will recognize that the present invention is not limited to the embodiments set forth herein, for example, it can be adapted in an analogous manner to other power or propulsion units. Instead of a pyrotechnic smoke assembly, so-called steam-generating devices may also be used. These may be more environmentally acceptable than a smoke assembly. The endothermic process accompanying steam production may additionally serve to cool the burning chamber and may thus allow the launch system to be reused, and particularly the launch tube and parts mounted thereon. In training rockets the necessary water tanks can be integrated into the rocket in place of tracking device electronics and explosive charges.

Combinations of pyrotechnic smoke units and water fed smoke units may also be utilized which can be connected to operate either sequentially and/or in parallel with each other.

We claim:

1. An assembly for generating an optical marking of the flight path of an air/space vehicle propelled by a power unit having an engine, said assembly being associated with the power unit, an output of said assembly being admixed to at least one of a group comprising an exhaust of the power unit and the atmosphere streaming past the vehicle in travel, the assembly comprising an optical marker generator attached to the engine, said optical marker generator being activated by the exhaust of the engine.

2. The assembly of claim 1, wherein the optical marker generator is a smoke unit.

3. The assembly according to claim 2, wherein the smoke unit comprises an annular chamber having an inner wall having bore holes, said bore holes being covered by a heat-sensitive foil.

4. The assembly according to claim 3, wherein said inner wall is in the form of a sieved tube having a diffuser area at a rear end thereof.

5. The assembly according to claim 4, wherein the diffuser area has axial bore holes.

6. The assembly according to claim 5, further including locking spigots sealing said axial bore holes.

7. The assembly according to claim 6, wherein the locking spigots are arranged on a holding band.

8. The assembly according to claim 3, wherein the annular chamber surrounds a cylindrical bore which includes an outwardly-tapered opening at an end adjacent a nozzle of the engine.

9. The assembly according to any of claims 2 to 8, further comprising a pyrotechnic mixture within the annular chamber.

10. The assembly according to claim 9, wherein the pyrotechnic mixture comprises about 22% zinc oxide, 18% polyvinylchloride, a reacting mixture of 22% zinc diamino chloride, 36% ammonium perchlorate and 2% collodion cotton.

11. The assembly according to claim 1, wherein the optical marker generator is a steam unit comprising a plurality of water tubes located in a hollow cylinder.

12. The assembly according to claim 11, wherein said water tubes include heat-sensitive seals.

13. The assembly according to claim 11, wherein said water tubes are secured by safety devices.

* * * * *